US012747534B2

(12) United States Patent
Chen et al.

(10) Patent No.: US 12,747,534 B2
(45) Date of Patent: Sep. 29, 2026

(54) FAUX HIDE MATERIAL

(71) Applicant: Ruggable LLC, Gardena, CA (US)

(72) Inventors: Lydia Wei-Ju Chen, Lakewood, CA (US); Therese Mona-Lisa Germain, Los Angeles, CA (US)

(73) Assignee: Ruggable LLC, Gardena, CA (US)

( * ) Notice: Subject to any disclaimer, the term of this patent is extended or adjusted under 35 U.S.C. 154(b) by 684 days.

(21) Appl. No.: 17/818,046

(22) Filed: Aug. 8, 2022

(65) Prior Publication Data

US 2024/0044074 A1 Feb. 8, 2024

(51) Int. Cl.
*D06N 3/14* (2006.01)
*D06N 3/00* (2006.01)

(52) U.S. Cl.
CPC ..... *D06N 3/145* (2013.01); *D06N 3/0009* (2013.01); *D06N 3/0036* (2013.01); *D06N 3/0075* (2013.01); *D06N 2203/068* (2013.01); *D06N 2211/066* (2013.01); *D06N 2213/066* (2013.01)

(58) Field of Classification Search
None
See application file for complete search history.

(56) References Cited

U.S. PATENT DOCUMENTS 3,988,488 A * 10/1976 Civardi ..... D06C 23/00 156/154
4,716,065 A * 12/1987 McLaughlin ..... B60N 3/046 428/95
2012/0288720 A1* 11/2012 Helmeke ..... C08G 18/12 156/332

FOREIGN PATENT DOCUMENTS

DE 202004019330 * 2/2005
DE 202011004902 * 1/2012

OTHER PUBLICATIONS

Machine translation of DE202011004902 (Year: 2012).*
Machine translation of DE202004019330 (Year: 2005).*

* cited by examiner

*Primary Examiner* — Shawn Mckinnon
(74) *Attorney, Agent, or Firm* — Meunier Carlin & Curfman LLC

(57) ABSTRACT

In various embodiments, a washable rug comprises a faux hide material. The faux hide material, comprising layers of synthetic material, including a top layer with directionalized polyester filaments providing a look and/or feel like natural hide. A cushioning layer includes knitted layers sandwiching attaching yarn. The faux hide material is sufficiently malleable to be folded, rolled, compressed, and withstand multiple wash and dry cycles.

19 Claims, 2 Drawing Sheets

FAUX HIDE MATERIAL

BACKGROUND

Technical Field

This disclosure relates to a faux hide material that may be used for various applications, including incorporation into household goods such as rugs and other floor coverings.

Background Art

Animal hide is the natural skin and fur of an animal, oftentimes a cow or calf, that has been treated and can be used to make various useful items. FIG. 1 depicts an example of a conventional hide rug 100 that is popular with some consumers. The hide rug 100 comprises the treated skin 101 of an animal along with fur 102, which may have unique patterning or coloration. Goods made from hide are inherently unique due to variations between individual animals from which hide is sourced. Hide rugs are also typically cut into an irregular shape 103 that traces the particular physiology of the source animal. Hide rugs thus can lend a naturalistic and rustic aesthetic to a room. Hide rugs also have a feel that many consumers find to be pleasant. Hide rugs tend to feel cool to the touch on warm days and warm to the touch on cool days. The fur on the top surface of a hide rug lends an extra dimension of tactility. Hide rugs are also relatively durable. Hide does not easily rip, tear, or puncture, and its resistance to stretching helps hide rugs maintain their shape over a long period of time. Thus, for instance, hide rugs can also be rolled up easily for storage and can unroll into their original form without retaining fold marks.

SUMMARY

There are, however, a number of downsides to hide rugs and other products made from natural hide. For one, many consumers oppose the use of animal-derived products such as hide due to animal welfare, environmental, or other concerns. Some hide rugs have coarse surfaces, depending on the treatment of the material and, in significant part, on the characteristics of the specific animal from which the hide was sourced. Hides are often relatively thin, typically ranging from about 3 to about 6 mm. Moreover, natural hides do not contain much cushioning, meaning that, without the use of an underlying pad, hide rugs are often uncomfortable. Further, as an animal product, hide can degrade over time in an unpleasant fashion, including taking on a musky odor, shedding, balding, warping and curling, or even rotting. With sun exposure over time, hide can also become stiff and hard, and can lose their natural resistance to tearing.

Hide rugs are also difficult to clean, and typically must be spot cleaned or dry cleaned. They cannot be washed in washing machines as they can be damaged by prolonged exposure to liquids.

Many hide rugs have hide or skin backing and thus are prone to shifting during use unless a rug pad is used. However, rug pads that work well with hide rugs are often not readily available to many consumers. Such rug pads often need to be custom cut to the shape of a particular hide rug.

Synthetic hides have been developed to try to overcome some of the disadvantages of natural hides, but many existing solutions come with their own downsides. Natural hide typically exhibits nap—that is, the furs on the hide have a directional appearance stemming from natural growth direction from the animal's hair follicles. Unfortunately, many conventional synthetic hides include piles made of synthetic, shiny furs with no nap, which poorly mimics the look and feel of natural hide. Another common characteristic of synthetic hides includes the use of jacquard fabrics (woven in pattern) or embossed faux suede. When used with no pile to try to emulate the look of natural hide, these synthetic hides do not look or feel very much like natural hide with intact hair. Other synthetic hide rugs, in their attempt to emulate the thinness of natural hides, do not provide much cushioning. Many synthetic hide rugs incorporate non-slip features such as having latex or silicone backing on the bottom surface (i.e., the surface that contacts the floor), but this type of backing will deteriorate over time, especially after multiple washings.

Accordingly, there is a need for a faux hide product that provides some of the benefits of natural hide and conventional synthetic hide while avoiding some of their downsides.

Disclosed is a multi-layered faux hide material that may be used for various applications, including incorporation into household goods such as rugs and other floor coverings. The faux hide material offers the look of natural hide with improved foot feel, durability, and washability. In many embodiments, the faux hide material does not include animal byproducts.

DETAILED DESCRIPTION

Disclosed is a faux hide material that can be used in household or commercial applications, such as to make floor mats, rugs, or carpeting.

Terms

The terms listed below each include their plain and ordinary meaning known to a person of skill in the art, which includes at least the provided information.

"Faux hide" means synthetic, non-natural material designed to appear and feel like natural hide.

"GSM" means grams per square meter (g/m 2).

"Nap" means the texture of a fabric and describes an alignment of the fibers.

"No animal byproducts" means the textile is made of synthetic filaments, yarns and/or fibers. It does not necessarily mean that adhesives or treatments are entirely free from chemicals or substances derived or sourced from animals or animal byproducts.

"Pile" means the raised surface or nap of a fabric, usually including upright loops or strands of yarn.

"Warp knit" means fabric that is produced by intermeshing loops in the knitting elements rather than interlacing warps and wefts as in a weaving machine.

Stack Layers

Figure 2:
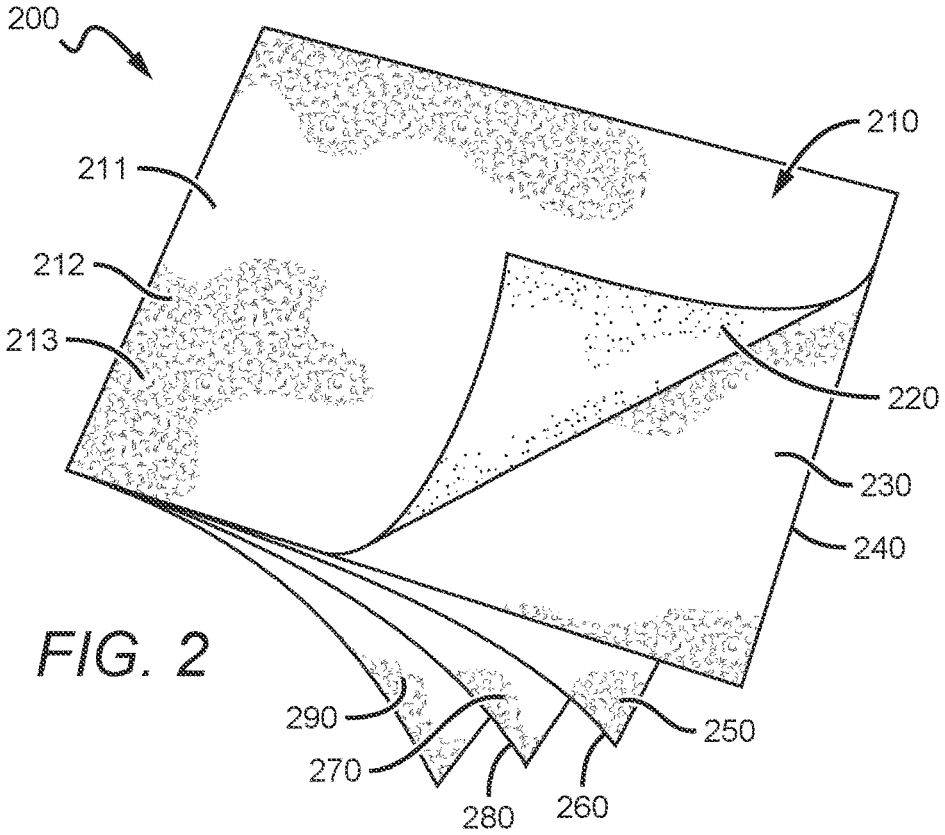
FIG. 2 is a perspective view of an exemplary faux hide material comprising a stack of layers according to an embodiment of the disclosure.
Figure 3:
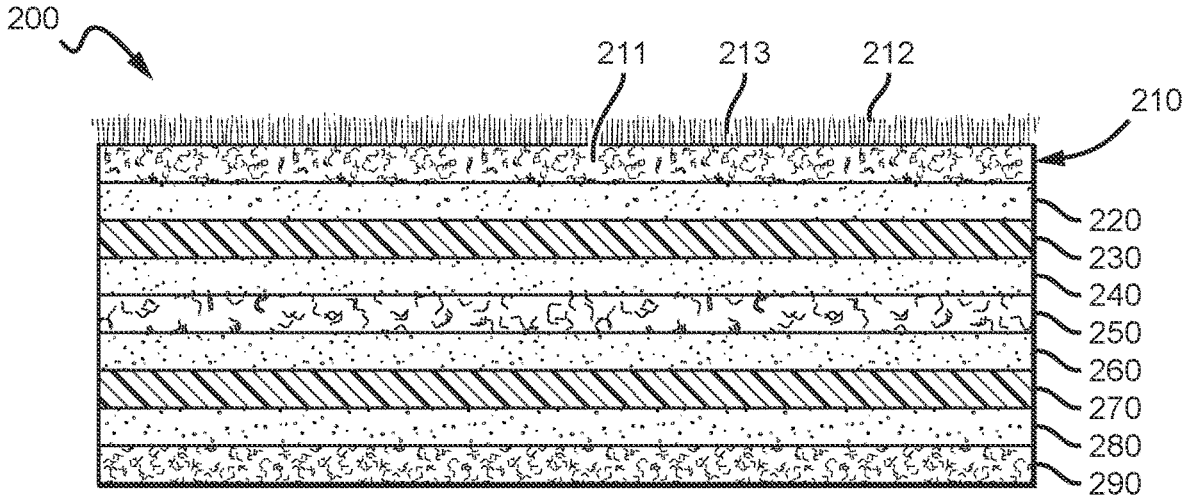
FIG. 3 is a side view of the stack of FIG. 2.

FIGS. 2 and 3 show the faux hide material 200 as a stack of layered materials. In various embodiments, the layered materials comprise five layers interspersed by adhesives as follows.

- A first material layer 210 comprises a knitted surface. The knitted surface provides aesthetics like that of natural hide.
- A second material layer 230 comprises a thermoplastic polyurethane. The polyurethane provides a liquid barrier that prevents, for example, spills or stains from penetrating deep into the stack.
- A hot melt adhesive 220 bonds the first material layer 210 to the second material layer 230.
- A third material layer 250 comprises a knitted spacer fabric. The spacer fabric provides cushioning to the stack to improve softness/pliability combined with rebound.
- A hot melt adhesive 240 bonds the second material layer 230 to the third material layer 250.
- A fourth material layer 270 a thermoplastic polyurethane. The polyurethane provides stability to the stack to reduce crimping at the edges thereof.
- A hot melt adhesive 260 bonds the third material layer 250 to the fourth material layer 270.
- A fifth material layer 290 comprises a knit backing. The knit backing is configured for use of the stack, such as, for example, as a washable rug attachable to a pad.
- A hot melt adhesive 280 bonds the fourth material layer 270 to the fifth material layer 290.

These layers are described in more detail below. It would be appreciated by a skilled artisan from the disclosure herein that embodiments or implementations may arrange the layers in a different order, use a different material for a particular layer, use additional or fewer layers, have liquid resistant layers that reduce rather than eliminate liquid passthrough, or make other changes, all without departing from the spirit or scope of this disclosure.

Layer 1: Knitted Surface—Aesthetics of Natural Hide

Figure 4:
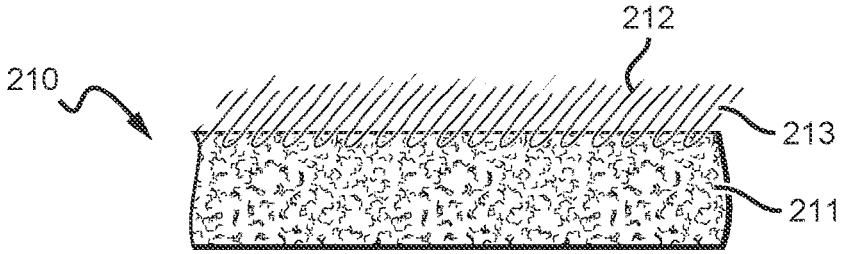
FIG. 4 shows a close-up view of an exemplary top layer of the stack of FIG. 2.

As shown in FIG. 4, the first layer 210 of the faux hide material 200 comprises a knitted surface, which may comprise a velboa material. This first layer 210 contributes significantly to the material's hide-like feel as the top surface of the first layer 210 is the outer facing portion of the faux hide material 200 and thus would be most often touched by a person. For instance, if a floor mat or rug were made of the faux hide material 200, then this first layer would provide the top surface that would be stepped on by a person.

The first layer 210 comprises a surface fabric 211 onto which filaments 212 are affixed to create a napped pile surface 213 on top. In a preferred embodiment, the filaments 212 are knitted into the surface fabric 211, such as by a warp knitting process in which, e.g., multiple parallel yarns are simultaneously looped vertically. In furtherance of the objective for the filaments 211 to have a look and feel similar to or reminiscent of animal hair on natural hide, the pile height, or the general length of the portions of the filaments 212 that protrude out from the surface fabric 211, may be in the range of about 3 mm to about 12 mm. More preferably, the pile height of the filaments 212 may be in the range of about 4.5 mm to about 8 mm, such as about 5 mm. In some embodiments, all the filaments 212 are of similar length, which lends a more uniform look. Alternatively, in other embodiments the filaments 212 have different lengths, which may be preferred by some as lending a more organic aesthetic.

In furtherance of a look and feel similar to or reminiscent of animal hair on natural hide, the filaments 212 may have a density in the range of about 300 GSM to about 400 GSM. More preferably, the density of the filaments 212 may be in the range of about 332.5 GSM to 385 GSM, such as about 350 GSM.

The filaments 212 on the surface fabric 211 preferably are treated to exhibit nap, or to point out at an angle so that the filaments have the appearance of hair growing in a general direction (directionalized), mimicking the natural growth direction of an animal's hair follicles, rather than pointing straight up from the surface fabric 211. The napped effect may be achieved by applying directional rolling pressure, such as by using a roller with barbs or hooks, to the filaments 212 to press them flat along a direction, and then heating the filaments 212 to fixate them in the pressed direction. In the alternative, the pile surface 213 can be made so that it has regions with different napping directions, or without a napping effect at all.

The filaments 212 may be made at least in part of polyester or other material not derived from animal byproducts. The filaments may be dyed into a desired color before they are affixed to the surface fabric 211, such as a white or other light color that is amenable to subsequent treatment using industrial dyeing or other color application processes. The napping of the pile also further optimizes the efficacy of color application. In a napped surface, the filament ends are angled in a uniform or semi-uniform direction, thus, at least a portion of the filament side faces upwards. Without napping, just the filament end points up. Thus, napping causes more surface area of the filaments 212 to face in the upward direction, making the filaments more amenable for surface treatments or applications. The ability for color to be applied to the surface layer 210 allows for designs that further mimic different species or breeds of animals, or even more fanciful designs. They also allow for the manufacture of faux hides that are individually unique, or effectively unique, just like natural hides.

The warp knit process causes the first layer 210 to have relatively less elasticity compared to ordinary knits. An artisan will recognize from the disclosure herein that the reduction in elasticity is caused by the vertical yarn construction described above. Thus, the first layer 210 mimics the non-stretch nature of natural hide such as cowhide. Further, less elasticity in the first layer 210 improves dimensional stability of the stack. Dimensional stability eases the complexity of manufacturing and sewing processes.

The warp knit construction further allows the pile to be dense with minimal shedding. An artisan will recognize from the disclosure herein that the increased density is achievable because the warp knitting construction allows for the use of a wider variety of yarn weights and fiber types, including denser yarns and fibers, as compared to some other types of construction. Increased density advantageously improves the aesthetic feel or tactile response of the layer to provide a soft hide-like surface with dense hair-like protrusions.

During manufacture, after the knitting process, the completed first layer 210 may be washed and dried to reduce later shrinkage and to remove any contaminants. The first layer 210 may then be heat set by undergoing an application of pressure and heat. The heat setting process as applied to the first layer 210, which comprises polyester, further reduces the potential for shrinkage, twisting, and wrinkling. Heat setting also structurally modifies the filaments 212 such that the pile 213 is fixed in its final napped appearance in which the pile lies flat or relatively flat with the filaments largely pointing in a particular direction, similar to the growth of hair from a cow's follicles, which lies flat or relatively flat against the animal's skin.

Although disclosed with specific reference to materials and manufacturing processes, an artisan will recognize from the disclosure herein different embodiments with different or alternative materials and/or manufacturing processes that accomplish the look and feel of natural hide using synthetic materials. For example, materials such as acrylic, modacrylic, polypropylene, rayon, and nylon may be used instead of or in junction with the above.

Adhesives

The adhesives 220 comprises an adhesive optimized for bonding synthetic fabric materials. It operates to adhere the topmost layer 210 (the knit surface) of the faux hide material 200 to the lower layers, and most directly the second layer 230. The selected adhesive material should be flexible and should retain its adhesive properties to keep the faux hide material together through rolling and folding and multiple wash and dry cycles. The adhesives 220 may be a 68 GSM polyurethane (PUR) hot melt adhesive comprised of about 85-100% isocyanate prepolymer mixed with methylene biphenyl diisocyanate. This adhesive has been found to withstand heat exposure during the production process of the faux hide material as well as through multiple wash and dry cycles.

Although disclosed with specific reference to polyurethane, an artisan will recognize from the disclosure herein different or alternative bonding materials and/or manufacturing processes that adhere the first layer to the second layer. For example, materials such as thermoplastic polyurethane adhesive may be used instead of or in junction with the above.

Layer 2: Thermoplastic Polyurethane—Liquid Barrier

Figure 5:
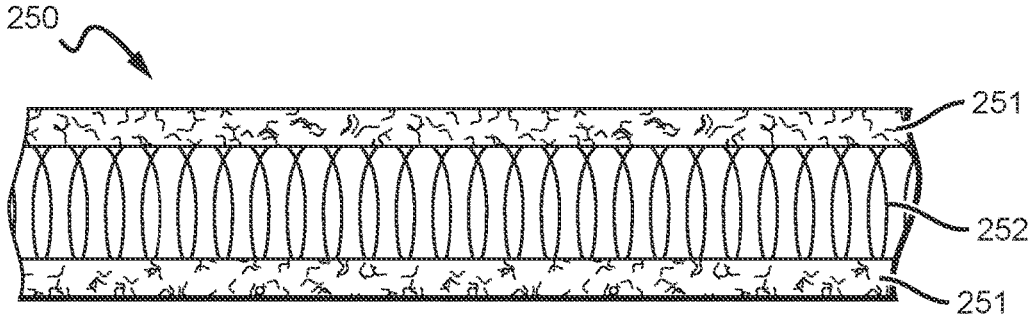
FIG. 5 shows a close up of an exemplary cushioning layer of the stack of FIG. 2.

The second layer 230 shown in FIG. 5 comprises a sheet of material that prevents liquids, including water from seeping through the stack. This layer may be omitted in some embodiments, particularly if liquid resistance is not needed for a particular use case of the faux hide material 200. The layer should be thick enough to prevent seepage but thin enough to allow the overall faux hide material 200 to maintain flexibility. It has been found that 15 GSM thermoplastic polyurethane (TPU) works well for this purpose, though it is possible to use TPU of other weights, or a different material altogether.

Although disclosed with specific reference to polyurethane, an artisan will recognize from the disclosure herein different or alternative liquid resistant or liquid barrier layers. For example, it is possible to lend a degree of liquid resistance to fabric by the application of spill-resistant coatings, but this may be less preferable as a number of the coatings available on the market contain PFAS chemicals, some of which are deemed to be dangerous and are currently banned or may become banned in some countries and U.S. states.

Layer 3: Knitted Spacer Fabric—Cushioning

With continued reference to FIG. 5, the third layer 250 comprises a knitted spacer fabric. The spacer fabric comprises two independently knitted fabrics 251 that are connected using a monofilament cushion yarn 252 to produce a three-dimensional sandwich or stack of materials. In some embodiments, the spacer fabric provides stack breathability. In some embodiments, the knitted fabrics are highly durable. As a sandwich, the knitted fabrics 251 and yarn 252 resist high pressure and crushing. For example, the sandwich structure compresses from the pressure of someone stepping on the faux washable rug and decompress when the pressure is removed.

The third layer 250 contributes significantly to the feel or tactile response of the overall faux hide material 200, especially the feel of stepping on the material. Its thickness is preferably in the range of about 2 mm to about 6 mm. More preferably, the third layer 250 thickness is in the range of about 2 mm to about 2.75 mm, such as about 2 mm.

The third layer 250 may be made largely of polyester blended with other material, such as, for example, a blend of about 95% polyester and about 5% spandex. The third 250 may use yarn of about 320 GSM, though different densities may be used. The spacer fabric is water permeable and malleable for washability.

As disclosed above, the third layer 250 provides the faux hide material 200 with a degree of compression and cushioning for a comfortable foot feel. In this aspect, the faux hide material 200 can be deemed superior to natural hide and typical synthetic hides, which typically do not provide compression or cushioning. In the alternative, the third layer 250 may be omitted if the cushioning effect it provides is not desired for the final faux hide product.

Although disclosed with specific reference to materials and manufacturing processes, an artisan will recognize from the disclosure herein different embodiments with different or alternative materials and/or manufacturing processes that accomplish the cushioning for the stack. For example, materials such as V-Lap and non-woven polyester may be used instead of or in junction with the above.

Layer 4: Thermoplastic Polyurethane—Stability and Anti-Edge Curling

The fourth layer 270 shown in FIG. 5 may comprise a thermoplastic polyurethane material, such as 22 GSM TPU. This material provides stability to the faux hide material 200 by preventing or reducing corner curling, torquing, or edge waviness (lifting), especially over multiple wash and dry cycles. This layer also provides additional protection against liquid penetration.

Although disclosed with specific reference to materials and manufacturing processes, an artisan will recognize from the disclosure herein different embodiments with different or alternative materials and/or manufacturing processes that accomplish the stability and/or anti-edge curling. For example, an alternative or additional mesh weave fabric may provide stability to the overall stack.

Layer 5: Knit Backing—Base

Figure 1:
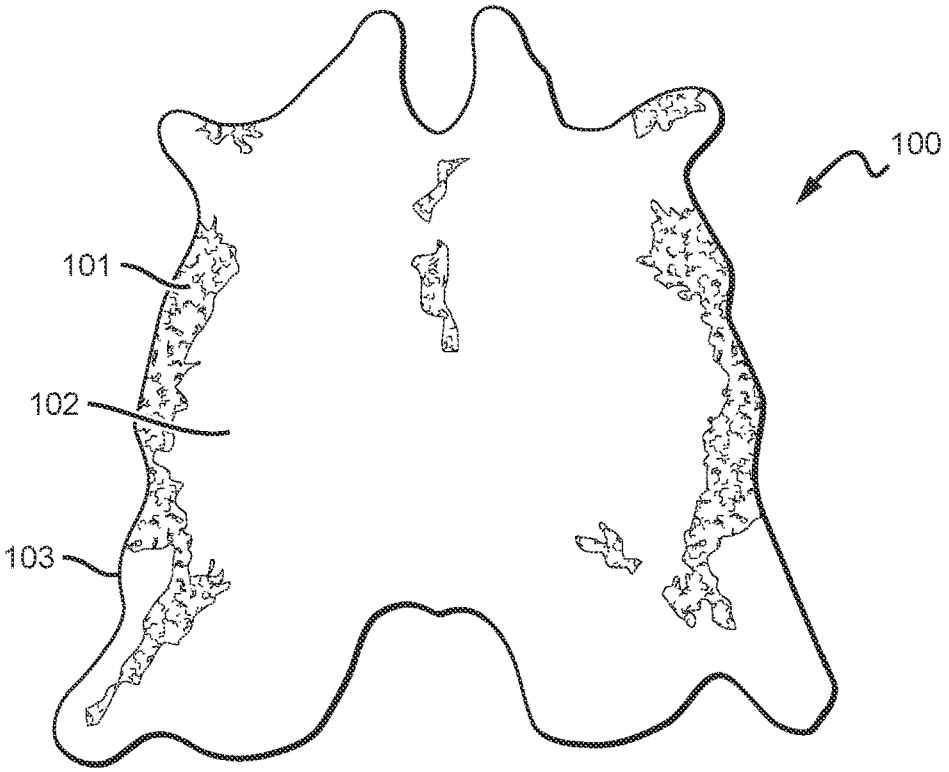
FIG. 1 PRIOR ART
FIG. 1 shows a prior art natural hide rug.

The fifth layer 290 may be the bottom layer of the stack. It may comprise a knit loop material of polyester yarn (e.g., of 50 denier and 120 GSM) designed to removably attach to a rug pad (not shown) comprising hook material, such as described in U.S. Pat. No. 8,309,198, incorporated in its entirety by reference. Alternatively, the fifth layer 290 may comprise hook material while loop material is disposed on the rug pad. In a preferred embodiment, the separate rug pad is cut to closely correspond to the shape of a rug made of the faux hide material 200, e.g., a shape similar to natural hide rugs such as seen in FIG. 1.

Alternatively, the fifth layer may itself comprise a rug pad, or one or more additional layers may be placed or adhered below the fifth layer to provide a rug pad. In still other embodiments, the base layer is configured to contact the floor or ground.

Although disclosed with specific reference to materials and manufacturing processes, an artisan will recognize from the disclosure herein different embodiments with different or alternative materials and/or manufacturing processes for the base layer. For example, materials such as velvet, fleece, felt, and TPE may be used instead of or in junction with the above.

Adhesives

The adhesives 240, 260, and 280 comprise adhesives optimized for bonding synthetic fabric materials. In some embodiments, the adhesives are similar or the same as adhesive 220, disclosed above. Although disclosed as using adhesives between each material layer, an artisan will recognize from the disclosure herein that adhesives may absorb through one or more particular material layers to adhere or bond more than two material layers together in the stack. Moreover, pressure rolling and/or heat treating may additionally allow for the use of fewer adhesives between each material layer than as depicted in FIG. 5.

The Multi-Layer Stack—Faux Hide Material

The faux hide material 200 described above comprises several layers of knit and TPU material bonded together using adhesive that is activated by the application of pressure and heat. Once bonded together, embodiments of the faux hide material resist deformation such as shrinkage, curling (including at its corners), warping, and torquing. The faux hide material can be produced in large sheets that can then be cut into arbitrary shapes, including the irregular shapes characteristic of natural hide rugs. Advantageously, because the faux hide material can be cut into any shape, it is possible to make a matching rug pad that exactly fits a rug made from the natural hide material. The faux hide material can also be dyed or undergo other color application processes, e.g., so that it can take on the patterns and coloration of natural animal hide and hair, or even fanciful designs not found in nature.

Embodiments of the faux hide material disclosed herein provide the look and feel of natural hide but includes no animal byproducts. It also avoids many of the downsides of natural hide, such as its tendency to degrade, smell, or even rot over time. The faux hide material also provides a cushioned foot feel, unlike typical natural hides, and is machine washable. The faux hide material is sufficiently malleable such that it can be folded, rolled, compressed, and go through multiple wash and dry cycles.

In an embodiment, the faux hide material 200 has a thickness in the range of about 4 mm to about 8 mm, such as about 6 mm, which renders the faux hide material 200 amenable to various production processes, such as the application of heat and pressure to bond the layers. Available machinery and techniques for applying heat and/or pressure may be limited in the thickness of input materials. The same may be true for available machinery and techniques for applying surface treatment to the faux hide material 200, such as color application processes.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including, "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a," "an," and "the" as used in this application and the appended claims are to be construed to mean "one or more" or "at least one" unless specified otherwise.

As used herein, a phrase referring to "at least one of" a list of items refers to any combination of those items, including single members. As an example, "at least one of A, B, or C" is intended to cover: A, B, C, A and B, A and C, B and C, and A, B, and C. Conjunctive language such as the phrase "at least one of X, Y and Z," unless specifically stated otherwise, is otherwise understood with the context as used in general to convey that an item, term, etc. may be at least one of X, Y or Z. Thus, such conjunctive language is not generally intended to imply that certain embodiments require at least one of X, at least one of Y and at least one of Z to each be present.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure and the principles and the novel features disclosed herein.

The invention claimed is:

1. A non-natural material manufactured to provide aesthetics of natural hide, the material comprising:

a top layer comprising a surface fabric and a plurality of polyester filaments affixed to the surface fabric and treated to be directionalized in a uniform non-upward direction from the surface fabric thereby aesthetically mimicking natural hide;

a liquid barrier layer;

a first adhesive layer bonding the surface fabric of the top layer to the liquid barrier layer;

a spacer fabric layer comprising top and bottom knit layers attached by a cushioned yarn, the spacer fabric layer providing a predefined cushioning for the material;

a second adhesive layer bonding the liquid barrier layer to the spacer fabric layer;

a stability layer configured to reduce curling at edges of said material; and a bottom layer configured for a suitable use of said material.

2. The material of claim 1, wherein the surface fabric of the top layer comprises knitted surface fabric.

3. The material of claim 1, wherein the liquid barrier layer comprises thermoplastic polyurethane (TPU).

4. The material of claim 1, wherein the stability layer comprises polyurethane.

5. A washable rug comprising the material of claim 1, wherein the bottom layer comprises attachment material configured to removably attach to a rug pad.

6. The material of claim 1, further comprising:

a third adhesive layer positioned between the spacer fabric layer and the stability layer; and a fourth adhesive layer positioned between the stability layer and the bottom layer.

7. The material of claim 1, wherein the plurality of polyester filaments have a pile height within a range of about 3 mm to about 12 mm.

8. The material of claim 1, wherein the plurality of polyester filaments have a pile height within a range of about 4.5 mm to about 8 mm.

9. The material of claim 8, wherein the pile height of the plurality of polyester filaments is about 5 mm.

10. The material of claim 1, wherein the plurality of polyester filaments have a density within a range of about 300 grams per square meter ($g/m^2$) ("GSM") to 400 GSM.

11. The material of claim 10, wherein the density of the plurality of polyester filaments is about 350 GSM.

12. The material of claim 1, wherein the spacer fabric layer has a thickness within a range of about 2 mm to about 6 mm.

13. The material of claim 12, wherein the spacer fabric layer has a thickness within a range of about 2 mm to about 2.75 mm.

14. The faux hide material of claim 1, wherein the spacer fabric layer has a thickness of about 2 mm.

15. A faux hide washable rug having attributes of natural hide, the washable rug comprising:

a knitted surface layer comprising napped polyester filaments;

a liquid protection layer;

a first adhesive layer bonding the knitted surface layer to the liquid protection layer;

a cushioning layer comprising a plurality of fabric layers interspaced with yarn;

a second adhesive layer bonding the liquid protection layer to the cushioning layer; and an attachment layer.

16. The washable rug of claim 15, wherein the napped polyester filaments have a pile height within a range of about 3 mm to about 12 mm.

17. The washable rug of claim 15, wherein the napped polyester filaments have a density within a range of about 300 GSM to 400 GSM.

18. The washable rug of claim 15, wherein the cushioning layer has a thickness within a range of about 2 mm to about 6 mm.

19. The material of claim 1, wherein the top and bottom knit layers of the spacer fabric layer are independently knitted fabrics connected with a monofilament cushion yarn to produce a three-dimensional stack of materials.

* * * * *